US012410926B2

(12) United States Patent
Hovardas et al.

(10) Patent No.: US 12,410,926 B2
(45) Date of Patent: Sep. 9, 2025

(54) FROST REMIDIATION AND FROST SENSOR

(71) Applicant: Carrier Corporation, Palm Beach Gardens, FL (US)

(72) Inventors: Sotiri Hovardas, Pittsboro, IN (US); Marcin Piech, East Hampton, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/957,347

(22) Filed: Sep. 30, 2022

(65) Prior Publication Data

US 2023/0106462 A1 Apr. 6, 2023

Related U.S. Application Data

(60) Provisional application No. 63/252,383, filed on Oct. 5, 2021.

(51) Int. Cl.
*F24F 11/36* (2018.01)
*F24F 11/77* (2018.01)
*F24F 110/10* (2018.01)

(52) U.S. Cl.
CPC ..... *F24F 11/36* (2018.01); *F24F 11/77* (2018.01); *F24F 2110/10* (2018.01)

(58) Field of Classification Search
CPC ..... F24F 2110/10; F24F 11/36; F24F 11/77; F24F 11/38; F24F 11/52; F24F 11/41; F24F 2130/00
See application file for complete search history.

(56) References Cited

U.S. PATENT DOCUMENTS

| | | | |
|---|---|---|---|
| 6,644,047 | B2 | 11/2003 | Taira et al. |
| 10,458,689 | B2 | 10/2019 | Suzuki |
| 10,488,065 | B2 | 11/2019 | Chen et al. |
| 10,533,764 | B2 | 1/2020 | Yamada et al. |
| 10,539,358 | B2 | 1/2020 | Suzuki et al. |
| 10,677,679 | B2 | 6/2020 | Gupte et al. |
| 10,935,454 | B2 | 3/2021 | Kester |
| 10,996,131 | B2 | 5/2021 | McQuade et al. |
| 11,015,828 | B2 | 5/2021 | Sakae et al. |
| 11,041,647 | B2 | 6/2021 | Weinert |

(Continued)

FOREIGN PATENT DOCUMENTS

| | | | | |
|---|---|---|---|---|
| CA | 2769240 A1 * | 2/2011 | ..... | B61B 10/04 |
| CN | 109795697 A * | 5/2019 | ..... | B64D 15/12 |

(Continued)

OTHER PUBLICATIONS

Extended European Search Report for European Application No. 22199608.5; Report Mail Date Feb. 2, 2023 (pp. 1-10).

*Primary Examiner* — Nelson J Nieves
(74) *Attorney, Agent, or Firm* — CANTOR COLBURN LLP

(57) ABSTRACT

A heating, ventilation, and air conditioning (HVAC) system includes a closed loop refrigeration circuit including a heat exchanger assembly, a detection assembly operable to detect refrigerant from the closed loop refrigeration circuit mixed with air, a mitigation device operable to monitor at least one parameter associated with operation of the detection assembly and a controller operable to determine if an alarm generated by the detection assembly is a false alarm in response to the at least one parameter monitored by the mitigation device.

20 Claims, 2 Drawing Sheets

(56) References Cited

U.S. PATENT DOCUMENTS

| | | | | |
|---|---|---|---|---|
| 11,060,746 | B2 | 7/2021 | Maddox et al. | |
| 11,060,775 | B2 | 7/2021 | Delgoshaei | |
| 11,067,304 | B2 | 7/2021 | Tomita et al. | |
| 11,067,321 | B2 | 7/2021 | Suzuki | |
| 11,079,149 | B2 | 8/2021 | Papas et al. | |
| 11,098,915 | B2 | 8/2021 | Crawford | |
| 11,125,457 | B1 | 9/2021 | Alfano et al. | |
| 11,131,471 | B1 | 9/2021 | Butler et al. | |
| 11,231,197 | B2 | 1/2022 | McQuade et al. | |
| 11,280,507 | B2 | 3/2022 | Yoneyama et al. | |
| 11,280,523 | B2 | 3/2022 | Sakae et al. | |
| 11,287,153 | B2 | 3/2022 | Delgoshaei | |
| 11,326,798 | B2 | 5/2022 | Green et al. | |
| 11,359,846 | B2 | 6/2022 | Welch | |
| 2004/0003914 | A1 | 1/2004 | Avila | |
| 2019/0170384 | A1* | 6/2019 | McQuade | G05B 15/02 |
| 2019/0331377 | A1* | 10/2019 | Matsuda | F25B 5/02 |
| 2020/0011580 | A1 | 1/2020 | Matsuda et al. | |
| 2020/0166470 | A1* | 5/2020 | Chen | G01N 27/16 |
| 2020/0263891 | A1 | 8/2020 | Noor et al. | |
| 2021/0108819 | A1 | 4/2021 | Chen et al. | |
| 2021/0108820 | A1 | 4/2021 | Hovardas et al. | |
| 2021/0207830 | A1* | 7/2021 | Chen | F24F 11/36 |
| 2021/0207831 | A1 | 7/2021 | Lord et al. | |
| 2021/0215418 | A1* | 7/2021 | Nash | F25D 21/08 |
| 2021/0285680 | A1 | 9/2021 | Atchison et al. | |
| 2021/0302056 | A1 | 9/2021 | Eskew et al. | |
| 2021/0364180 | A1* | 11/2021 | Chen | G01M 3/04 |
| 2022/0252291 | A1* | 8/2022 | Alfano | F24F 11/76 |
| 2022/0406157 | A1* | 12/2022 | Weeres | G01B 7/26 |

FOREIGN PATENT DOCUMENTS

| | | | | | |
|---|---|---|---|---|---|
| CN | 111997724 | A | * | 11/2020 | F01N 11/00 |
| EP | 2880375 | B1 | * | 3/2019 | F25B 1/10 |
| EP | 3640567 | A1 | | 4/2020 | |
| EP | 3869113 | A1 | | 8/2021 | |
| JP | 01266458 | A | * | 10/1989 | |
| JP | 2010256049 | A | | 11/2010 | |
| JP | 6825336 | B2 | * | 2/2021 | |
| WO | 2019116437 | A1 | | 6/2019 | |
| WO | WO-2020010082 | A1 | * | 1/2020 | F24F 11/36 |
| WO | 2020116437 | A1 | | 6/2020 | |
| WO | 2021050618 | A1 | | 3/2021 | |
| WO | 2021050886 | A1 | | 3/2021 | |

* cited by examiner

FROST REMIDIATION AND FROST SENSOR

CROSS-REFERENCE TO RELATED APPLICATIONS

This application claims the benefit of U.S. Provisional Application No. 63/252,383 filed Oct. 5, 2021, the disclosure of which is incorporated herein by reference in its entirety.

BACKGROUND

Exemplary embodiments of the present disclosure relate to refrigerant detection assemblies for detecting leaks of moderate to low global warming potential (GWP) refrigerants, and more particularly, to a refrigeration system and method for mitigating false alarms generated by a detection assembly.

A wide variety of technologies exist for cooling applications, including but not limited to evaporative cooling, convective cooling, or solid state cooling such as electrothermic cooling. One of the most prevalent technologies in use for residential and commercial refrigeration and air conditioning is the vapor compression refrigerant heat transfer loop. Although existing refrigerants are effective coolants, the effect they can have on the environment has led to the institution of requirements that new refrigerants, which have moderate-to-low sGWP values, be employed instead. Moderate-to-low GWP refrigerants (i.e., A2L refrigerants) can be mildly flammable and thus their use in air conditioning systems can present risks that need to be addressed. In particular, to the extent that refrigerant leaks are possible in air conditioning systems, it is desirable to have an environmentally robust leak detection systems in place when A2L refrigerants are in use in heating, ventilation, air conditioning and refrigeration (HVAC&R) products and other similar systems.

Refrigerant leaks can be detected using various types of refrigerant detection assemblies. However, when used in very low temperature applications, frost can accumulate on these detection assemblies and generate a false alarm. Because operation of the HVAC system is typically prioritized to mitigate the refrigerant leak, such false alarms can be a nuisance for occupants.

BRIEF DESCRIPTION

According to an embodiment, a heating, ventilation, and air conditioning (HVAC) system includes a closed loop refrigeration circuit including a heat exchanger assembly, a detection assembly operable to detect refrigerant from the closed loop refrigeration circuit mixed with air, a mitigation device operable to monitor at least one parameter associated with operation of the detection assembly and a controller operable to determine if an alarm generated by the detection assembly is a false alarm in response to the at least one parameter monitored by the mitigation device.

In addition to one or more of the features described above, or as an alternative to any of the foregoing embodiments the mitigation device is a temperature sensor.

In addition to one or more of the features described above, or as an alternative to any of the foregoing embodiments the at least one parameter is an ambient temperature.

In addition to one or more of the features described above, or as an alternative to any of the foregoing embodiments the at least one parameter is correlated with a temperature.

In addition to one or more of the features described above, or as an alternative to any of the foregoing embodiments the mitigation device is a camera.

In addition to one or more of the features described above, or as an alternative to any of the foregoing embodiments the at least one parameter is an appearance of the heat exchanger assembly.

In addition to one or more of the features described above, or as an alternative to any of the foregoing embodiments comprising: a blower operable to move a flow of air across the heat exchanger assembly and a thermostat operable to generate a signal indicating a temperature demand of an area to be conditioned by the HVAC system, wherein the blower and the thermostat are operably coupled to the controller.

In addition to one or more of the features described above, or as an alternative to any of the foregoing embodiments the HVAC system is operable in a first mode when the detection assembly generates an alarm and the HVAC system is operable in a second mode when the detection assembly generates the false alarm.

In addition to one or more of the features described above, or as an alternative to any of the foregoing embodiments in the first mode, the blower is operational and the thermostat cannot communicate heating and cooling calls to the controller.

In addition to one or more of the features described above, or as an alternative to any of the foregoing embodiments in the second mode, the blower is operational and the thermostat is configured to communicate heating calls to the controller.

According to another embodiment, a method of operating a heating, ventilation, and air conditioning (HVAC) system includes generating an alarm indicating a refrigerant leak in the HVAC system via a detection assembly, monitoring a parameter associated with operation of the detection assembly, and determining if the alarm is false in response to the parameter.

In addition to one or more of the features described above, or as an alternative to any of the foregoing embodiments in response to determining that the alarm is false, actively defrosting the detection assembly.

In addition to one or more of the features described above, or as an alternative to any of the foregoing embodiments actively defrosting the detection assembly further comprises blowing a flow of warm air over the detection assembly.

In addition to one or more of the features described above, or as an alternative to any of the foregoing embodiments a thermostat of the HVAC system is configured to communicate a heating call to a controller of the HVAC system during the actively defrosting the detection assembly.

In addition to one or more of the features described above, or as an alternative to any of the foregoing embodiments comprising operating a blower of the HVAC system and restricting communication of heating and cooling calls from a thermostat to a controller of the HVAC system in response to determining that the alarm is a real alarm.

In addition to one or more of the features described above, or as an alternative to any of the foregoing embodiments monitoring the parameter associated with the operation of the detection assembly further comprises detecting an ambient temperature.

In addition to one or more of the features described above, or as an alternative to any of the foregoing embodiments when the ambient temperature is less than 0° C., determining that the alarm is false.

In addition to one or more of the features described above, or as an alternative to any of the foregoing embodiments monitoring the parameter associated with the operation of the detection assembly further comprises monitoring an appearance of a heat exchanger assembly of the HVAC system.

In addition to one or more of the features described above, or as an alternative to any of the foregoing embodiments determining that the alarm is false further comprises determining that the appearance of the heat exchanger assembly includes frost accumulation.

In addition to one or more of the features described above, or as an alternative to any of the foregoing embodiments monitoring the parameter associated with the operation of the detection assembly is initiated in response to generating the alarm.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
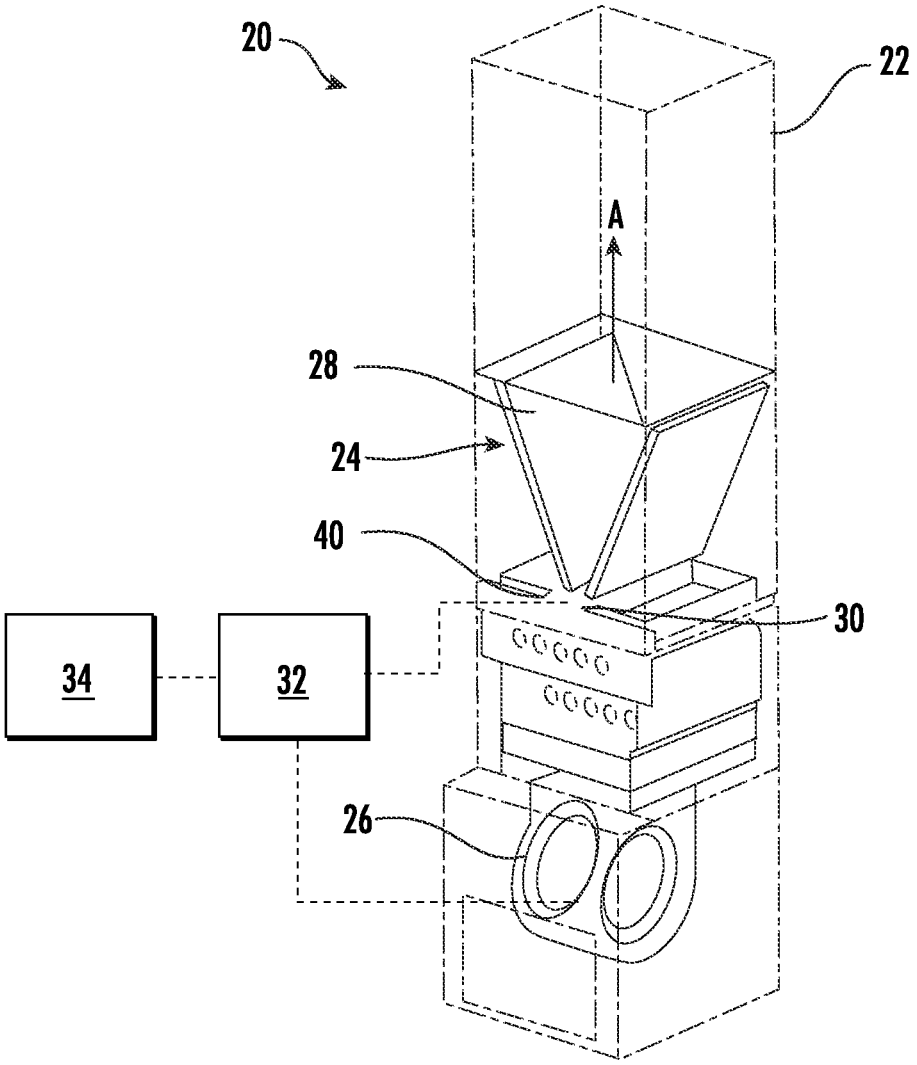
FIG. 1 is a perspective view of an exemplary heating, ventilation, and air conditioning (HVAC) system according to an embodiment.

With reference now to FIG. 1, an example of a heating, ventilation, and air conditioning (HVAC) system 20 is illustrated, depicted as a furnace coil or fan coil unit 20. Although described herein as furnace or fan coil unit it should be appreciated that the HVAC system 20 may be any heating or cooling system. As shown, the furnace coil or fan coil unit 20 includes a cabinet or housing duct 22 within which various components of the HVAC system are located. For example, housed within the cabinet 22 of the furnace coil or fan coil unit 20 is a heat exchanger assembly 24 configured to heat and/or cool the adjacent air. A blower or fan assembly 26 may also be arranged within the cabinet 22 or alternatively, at a position outside of but in fluid communication with the cabinet 22. The blower 26 is operable to circulate a flow of air A through the interior of the cabinet 22, across the heat exchanger assembly 24. Depending on the desired characteristics of the furnace coil or fan coil unit 20, the blower 26 may be positioned either downstream with respect to the heat exchanger assembly 24 (i.e., a "draw through" configuration), or upstream with respect to the heat exchanger assembly 24 (i.e., a "blow through" configuration), as shown in FIG. 1.

The heat exchanger assembly 24 is part of a closed loop refrigeration circuit and may include any of a plurality of configurations. As illustrated in FIG. 1, the heat exchanger assembly 24 includes one or more heat exchanger coils 28 arranged in a non-linear configuration. For example, the heat exchanger assembly 24 may have a generally V-shaped configuration, a generally A-shaped configuration, or a generally N-shaped configuration, as is known in the art. In other embodiments, the heat exchanger assembly 24 may include a single heat exchanger coil 28 arranged at an angle with respect to the flow path of air A through the cabinet 22. In embodiments where the furnace coil or fan coil unit 20 is configured to provide cool air, the heat exchanger assembly 24 absorbs heat from the air A passing through the heat exchanger assembly 24 and the resultant cool air A is provided to a space to be conditioned. It should be understood that the refrigeration system illustrated herein is intended as an example only and that a HVAC system 20 having any suitable configuration is within the scope of the disclosure.

With continued reference to FIG. 1, the refrigerant circulating within the heat exchanger assembly 24 may, in rare instances, leak. When utilizing A2L refrigerants, a leak of refrigerant could lead to undesirable consequences due to the mildly flammable nature of A2L refrigerants. Accordingly, the HVAC system 20 may include at least one detection sensor or assembly 30 operable to detect a refrigerant leak therein. Examples of the detection sensor or assembly 30 include but are not limited to a point sensor and a line of sight or beam sensor. Further, the technologies used by one or more detection sensors may include non-dispersive infrared (NDIR), photoacoustic spectroscopy (PAS), quantum cascade laser spectroscopy (QCLS), tunable diode laser spectroscopy (TDLS), thermal conductivity (TC), metal oxide semiconductor (MOS), ultrasonic, speed of sound, and ultraviolet spectroscopy for example. However, it should be understood that any suitable type of detection sensor or assembly 30 is within the scope of the disclosure.

As shown in FIG. 1, the HVAC system 20 includes a controller, illustrated schematically at 32. The controller is operably coupled to the at least one detection assembly 30 and to the motor (not shown) of the blower 26. In addition, a thermostat 34 for selecting a temperature demand of the area to be conditioned by the HVAC system 20 is arranged in communication with the controller 32. The controller 32 is configured to control operation of the furnace coil or fan coil unit 20 in response to the temperature setting of the thermostat 34.

When a detection assembly 30 detects a level of refrigerant that exceeds a predetermined threshold, the detection assembly 30 enters an alarm state and the controller 32 is configured to operate the HVAC system 20 in a first mode. In the first mode, the controller 32 may be configured to isolate one or more possible ignition sources by turning off the HVAC system 20 as needed. For example, in embodiments where the HVAC system 20 includes a non-communicating thermostat, the controller 32 would cut power to the thermostat 34 to prevent calls for heat and/or cooling provided to the thermostat 34 from being communicated to the controller 32 and activating the HVAC system 20. In embodiments where the thermostat is a communicating thermostat, isolating one or more possible ignition sources includes de-energizing HVAC operating circuits directly, such as the furnace ignition circuit, AC compressor circuit, etc. In addition, during operation in the first mode, the controller 32 may be configured to initiate operation of a blower 26. Operation of the blower 26 is intended to dissipate the refrigerant within the atmosphere.

At very cold temperatures, frost may accumulate on a detection assembly 30. In response to this frost buildup, the detection assembly 30 sometimes generates a false signal indicating that the sensed refrigerant exceeds the predetermined threshold and enters an alarmed state. To prevent the shutdown of the HVAC system 20 in response to the occurrence of such false alarms, in an embodiment, the HVAC system 20 includes one or more mitigation devices 40 configured to evaluate a condition of the detection assembly 30 and/or monitor at least one parameter associated with operation of the detection assembly 30, such as to determine whether frost has accumulated thereon. The mitigation device 40 may include a temperature sensor configured to measure the ambient temperature or another device configured to monitor another parameter that can be correlated with a temperature. In an embodiment, the mitigation device 40 includes a camera or other visual monitoring device operable to detect a change in the appearance of the heat exchanger assembly 24, such as the accumulation of frost thereon.

In embodiments where the mitigation device 40 includes a temperature sensor, the temperature measured by the temperature sensor 40 may be solely dedicated to detecting false alarms of the detection assembly 30. In such embodiments, the temperature sensor 40 may be mounted in a similar location to the detection assembly 30. For example, the temperature sensor 40 may be located directly adjacent to the detection assembly 30 near the heat exchanger assembly 24, or alternatively, may be integral with the detection assembly 30. However, embodiments where the temperature sensor is arranged at another location about the HVAC system 20, such as at a location remote from the detection assembly 30 are also contemplated herein.

Figure 2:
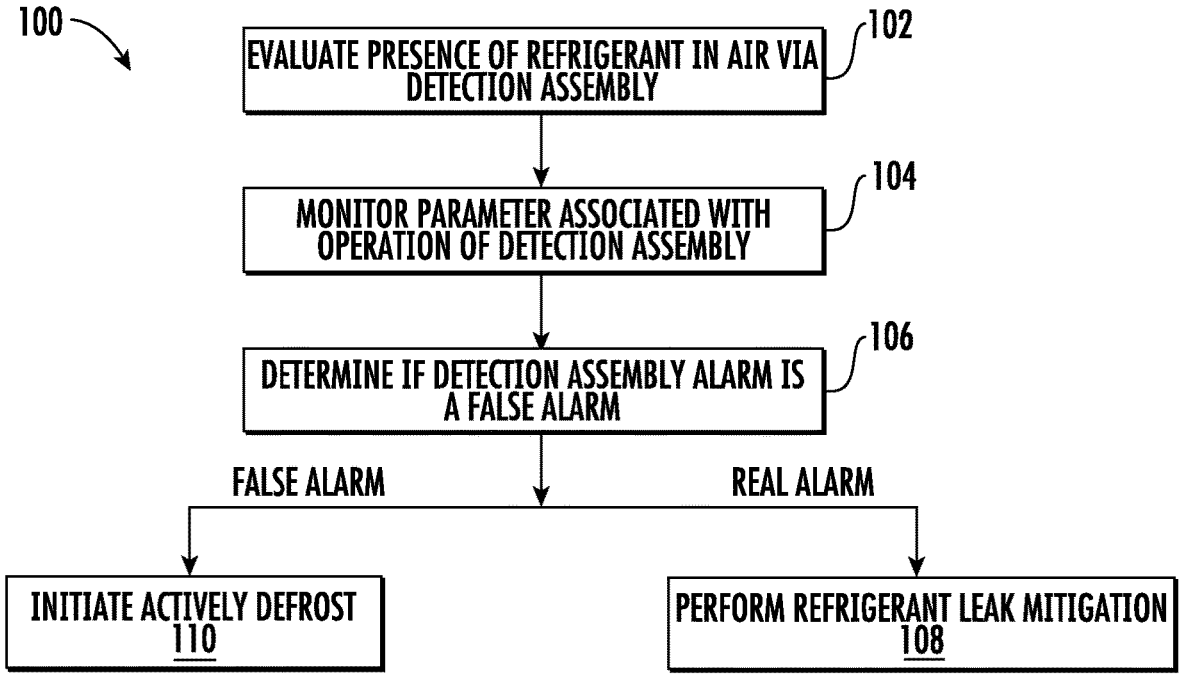
FIG. 2 is a flow diagram of a method for mitigating false alarms of a detection assembly of the HVAC system according to an embodiment.

A method 100 of operating the HVAC system 20 to perform frost mitigation is illustrated in more detail in FIG. 2. In operation, the detection assembly 30 is continuously or intermittently monitoring the refrigerant within the air, as shown in block 102. At the same time, the one or more mitigation devices 40 are operable to monitor a respective condition, such as temperature or visual appearance for example, either continuously or at intervals (block 104) and will report the measured condition to the controller 32. However, it should be understood that in an embodiment, the monitoring performed by the mitigation device 40 need not begin until the detection assembly 30 enters an alarm state. Using the information provided by the mitigation device 40, as shown in block 106, the controller 32 determines whether the alarm generated by the detection assembly 30 is a false alarm.

If the detection assembly 30 is in an alarm state and the parameter being monitored by the mitigation device 40 indicates that frost could be present, the controller 32 will determine that the detection assembly 30 is in a false alarm state due to frost accumulation. In embodiments where the mitigation device 40 is a temperature sensor, if the temperature measured by the temperature sensor 40 is less than about 0° C. or 32° F., the controller 32 will determine that the detection assembly 30 is in a false alarm state due to frost accumulation. Similarly, if the mitigation device 40 is a camera and the camera has detected a visual change in the appearance of a heat exchanger coil 28, the controller will determine that the detection assembly 30 is in a false alarm state due to frost accumulation. However, in embodiments where the sensed temperature is above freezing, or where the appearance of the heat exchanger coil 28 is unchanged, an alarm generated by the detection assembly 30 will be considered a valid or real alarm (see block 108). In such instances, the controller 32 will implement refrigerant leak mitigation by activating the blower 26 and turning off the components of the HVAC system 20 to isolate possible ignition sources as previously described.

In response to determining that the detection assembly 30 is in a false alarm state, the controller 32 may be configured to initiate operation of the HVAC system 20 in a second mode to actively defrost the detection assembly 30, see block 110. This defrosting of the detection assembly may be performed using any of the available heating modes of the HVAC system 20. In an embodiment, operation of the HVAC system 20 to defrost the detection assembly 30 includes initiating operation of the blower 26 to move a flow of warm air over the detection assembly 30 to thaw or melt any frost accumulation on the detection assembly 30. However, embodiments where the HVAC system 20 simply blows air over the detection assembly 30 without actively heating the air are also contemplated herein. Alternatively, or in addition, the HVAC system 20 may include a heater operably coupled to the detection assembly 30. The heater may be located remotely from the detection assembly 30 or may be integral with the detection assembly 30. In such embodiments, the heater may be activated in instances where there is an indication of frost-formation. However, in embodiments where the heater is integral with the detection assembly 30 and the heater is continuously operational, such as to prevent condensation for example, in response to detection of a false alarm state, the current or power directed to the heater may be increased relative to the typical current and/or power.

Unlike a regular alarm state, in a false alarm state the thermostat 34 will remain operational. More specifically, the thermostat will be able to communicate a heating call to the controller 32 requesting delivery of hot air to the area being conditioned. Accordingly, in the second mode, both the blower 26 and the thermostat 34 are operational enabling both heating and cooling functions.

By including one or more mitigation devices, the HVAC system 20 may be operated to warm the detection assembly 30 to reduce the duration of a false alarm state. Further, because the HVAC system 20 remains operable to provide conditioned air when the detection assembly 30 is in a false alarm state, occupants of the building will not notice an interruption in service.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heating, ventilation, and air conditioning (HVAC) system, comprising:

a closed loop refrigeration circuit including a heat exchanger assembly;

a detection assembly operable to detect refrigerant from the closed loop refrigeration circuit mixed with air;

a mitigation device operable to monitor at least one parameter associated with operation of the detection assembly to detect if frost is present at the detection assembly; and a controller operable to both the detection assembly and the mitigation device, the controller being operable to determine if an alarm generated by the detection assembly is a false alarm in response to the at least one parameter monitored by the mitigation device.

2. The HVAC system of claim 1, wherein the mitigation device is a temperature sensor.

3. The HVAC system of claim 2, wherein the at least one parameter is an ambient temperature.

4. The HVAC system of claim 1, wherein the at least one parameter is correlated with a temperature.

5. The HVAC system of claim 1, wherein the mitigation device is a camera.

6. The HVAC system of claim 5, wherein the at least one parameter is a visual appearance of the heat exchanger assembly.

7. The HVAC system of claim 1, further comprising:

a blower operable to move a flow of air across the heat exchanger assembly; and a thermostat operable to generate a signal indicating a temperature demand of an area to be conditioned by the HVAC system, wherein the blower and the thermostat are operably coupled to the controller.

8. The HVAC system of claim 7, wherein the HVAC system is operable in a first mode when the detection assembly generates an alarm and the HVAC system is operable in a second mode when the detection assembly generates the false alarm.

9. The HVAC system of claim 8, wherein in the first mode, the blower is operational and the thermostat cannot communicate heating and cooling calls to the controller.

10. The HVAC system of claim 8, wherein in the second mode, the blower is operational and the thermostat is configured to communicate heating calls to the controller.

11. A method of operating a heating, ventilation, and air conditioning (HVAC) system comprising:

generating an alarm indicating a refrigerant leak in the HVAC system via a detection assembly;

monitoring a parameter associated with the detection assembly via a mitigation device in response to generating the alarm indicating a refrigerant leak in the HVAC system, wherein the parameter indicates a presence of frost at the detection assembly; and determining that the alarm is false in response to the parameter.

12. The method of claim 11, wherein in response to determining that the alarm is false, actively defrosting the detection assembly.

13. The method of claim 12, wherein actively defrosting the detection assembly further comprises blowing a flow of warm air over the detection assembly.

14. The method of claim 12, wherein a thermostat of the HVAC system is configured to communicate a heating call to a controller of the HVAC system during the actively defrosting the detection assembly.

15. The method of claim 11, further comprising:

operating a blower of the HVAC system and restricting communication of heating and cooling calls from a thermostat to a controller of the HVAC system in response to determining that the alarm is a real alarm.

16. The method of claim 11, wherein determining if frost is present at the detection assembly further comprises detecting an ambient temperature.

17. The method of claim 16, wherein when the ambient temperature is less than 0° C., determining that the alarm is false.

18. The method of claim 11, wherein determining if frost is present at the detection assembly further comprises monitoring a visual appearance of a heat exchanger assembly of the HVAC system.

19. The method of claim 18, wherein determining that the alarm is false further comprises determining that the visual appearance of the heat exchanger assembly includes frost accumulation.

20. The method of claim 11, wherein determining if frost is present at the detection assembly is initiated in response to generating the alarm.

* * * * *